United States Patent [19]

Farmer et al.

[11] 4,008,648

[45] Feb. 22, 1977

[54] TELESCOPIC RAM

[75] Inventors: Stanley E. Farmer; Donald M. Faust, both of Gresham; Harry F. Weinert, Portland, all of Oreg.

[73] Assignee: Cascade Corporation, Portland, Oreg.

[22] Filed: Nov. 11, 1975

[21] Appl. No.: 630,781

[52] U.S. Cl. ..... 91/168; 91/189 R

[51] Int. Cl.[2] ..... F15B 11/18

[58] Field of Search ..... 91/168, 189 R

[56] References Cited

UNITED STATES PATENTS

| | | | |
|---|---|---|---|
| 2,390,702 | 12/1945 | Gail et al. | 91/168 |
| 3,188,917 | 6/1965 | Quayle | 91/168 |

FOREIGN PATENTS OR APPLICATIONS

| | | | |
|---|---|---|---|
| 1,240,743 | 2/1965 | Germany | 91/168 |
| 877,869 | 9/1961 | United Kingdom | 91/168 |

*Primary Examiner*—Paul E. Maslousky

*Attorney, Agent, or Firm*—Kolisch, Hartwell, Dickinson & Stuart

[57] ABSTRACT

A single-acting, three-stage, four-section telescopic ram for use in conjunction with a triple-lift type mast in a lift truck. The ram features an extremely low overall length when fully contracted, thus affording good operator visibility. The ram also is capable of producing surprisingly "high-lift" despite its low contracted profile. Further, the ram features an internal construction that produces constant lifting and lowering speeds for a load, as well as providing for positive control over the sequence of movements of parts in and on an associated mast.

14 Claims, 6 Drawing Figures

TELESCOPIC RAM

BACKGROUND AND SUMMARY OF THE INVENTION

This invention pertains to a multistage, extensible-contractible hydraulic ram, and more particularly to a single-acting, three-stage, four-section telescopic ram which is especially adapted for use in conjunction with a triple-lift-type mast in a lift truck.

Many industrial lift trucks are equipped with a so-called triple-lift-type, vertically extensible-contractible mast. Such masts include inner, intermediate and outer sections which are extensible vertically relative to one another, with the inner section carrying a carriage on which any one of a variety of load-handling attachments, such as lift forks, may be mounted. The carriage is disposed for travel up and down on and along the inner mast section during what is normally referred to as the "free-lift" operating stage of the truck. Raising and lower of such a mast is accomplished through mechanism substantially always including a multisection hydraulic ram, with various sheaves and chains used to provide operative interconnections between the ram and mast sections.

A number of features are usually sought in such an arrangement. For example, it is important that during times when a lift truck is being driven and maneuvered from one location to another, the operator have good forward visibility. Under such a driving situation, it is usual that a mast and ram are substantially fully contracted or lowered.

Further, in order to avoid jolting of a load as it is raised and lowered, it is desirable that the raising and lowering speed of a carriage, throughout the entire vertical range of travel of the carriage, be as constant as possible. Jolting will occur, of course, if any abrupt changes in speed take place. Obviously, such jolting presents the serious hazard of dropping a load and causing personal injury and/or other damage.

Additionally, it is desirable that the sequence in which various movable parts in and on a mast travel with respect to one another be controlled positively. In other words, for each type mast and associated carriage there is a specific sequence of related movements which are proper, and it is desirable to insure that nothing causes "mis-sequencing" of these parts.

Still another consideration is that while it is important to obtain good visibility for an operator with the mast and ram contracted, this characteristic should not, if possible, affect a "high-lift" capability for a load.

A general object of the present invention, therefore, is to provide a novel multistage ram which is capable of being incorporated with a triple-lift-type mast in a lift truck, in a manner which will take all of the above-mentioned concerns and considerations into account in a very practical and satisfactory manner.

According to a preferred embodiment of the invention, the ram comprises, basically, a single-acting, four-part, three-stage construction, including a cylinder, an outer large piston slidably mounted within and extensible from the cylinder, an intermediate piston slidably mounted within and extensible from the outer piston, and an inner piston slidably mounted within and extensible from the intermediate piston.

In this arrangement, pressure fluid introduced to extend the ram enters the cylinder, and is applied against the effective working surface area of the outer piston, and also simultaneously against the effective working surfaces of the intermediate and inner pistons. The latter conditon results from the presence of an open fluid passage system extending through the outer piston between the outer cylinder and the intermediate and inner pistons. Provided in this fluid passage system is a valve that is held open with the ram contracted, which valve closes later with extension of the outer piston for the purpose of inhibiting flow between the opposite sides of the latter.

Provided between the cylinder and the side of the outer piston which is opposite that having what was just called its "effective working surface area", is a space containing fluid, which space connects through another fluid passage system with a portion of the first-mentioned fluid passage system. A check valve disposed within this other passage system blocks the escape of fluid from the space with the ram contracted. Such blockage prevents initial movement of the outer piston. An actuator for opening this valve is included, which actuator operates to open the valve at a certain condition of ram extension, which condition will be explained shortly.

Ideally, the effective working surface area on the outer piston is twice that on the intermediate piston. Also, the dimensions of the space just mentioned are such that the volume of fluid which escapes this space with extension of the outer piston at a certain speed relative to the cylinder, is exactly the same as the volume of fluid required to produce extension of the inner piston at the same speed relative to the intermediate piston.

With pressure fluid supplied to the cylinder at a substantially constant rate, what first occurs is that the intermediate piston extends at a certain speed relative to the outer piston. The inner piston is carried as a unit with the intermediate piston. The outer piston remains stationary because of the fact that the escape of fluid from the "space" mentioned is prevented.

Upon the intermediate piston reaching substantially full extension, a portion thereof engages and acts upon a stem connected to the actuator of the second-mentioned valve — opening this valve. Such opening permits the escape of fluid from the space between the outer piston and the cylinder, and hence, permits movement of the former.

Continued supplying of pressure fluid at the same rate then causes extension of the outer piston at half the speed at which the intermediate piston previously extended. Such movement of the outer piston results in the first-mentioned valve closing to block the flow of fluid through the outer piston. As a consequence, fluid escaping from the "space" now flows into the hollow interior of the intermediate piston to act on and cause extension of the inner piston relative to the intermediate piston. This action continues until full extension of the ram. The speed at which the inner piston extends relative to the intermediate piston is the same as that at which the outer piston extends relative to the cylinder. Hence, the overall extension speed of the ram is substantially constant from full contraction to full extension.

Positive sequencing is achieved through the use of the two valves discussed, as well as through the selection of the specific relationships mentioned between the effective working surface areas on the pistons.

Thus, the ram of the invention can readily be incorporated with a triple-lift-type mast to produce the desired kind of performance mentioned above. The fact that the ram includes four sections insures its having a relatively short overall length when fully contracted, which condition contributes to good forward visibility for a truck operator.

These and other objects and advantages which are attained by the invention will become more fully apparent as the description which now follows is read in conjunction with the accompanying drawings.

DETAILED DESCRIPTION OF THE INVENTION

Figure 1:
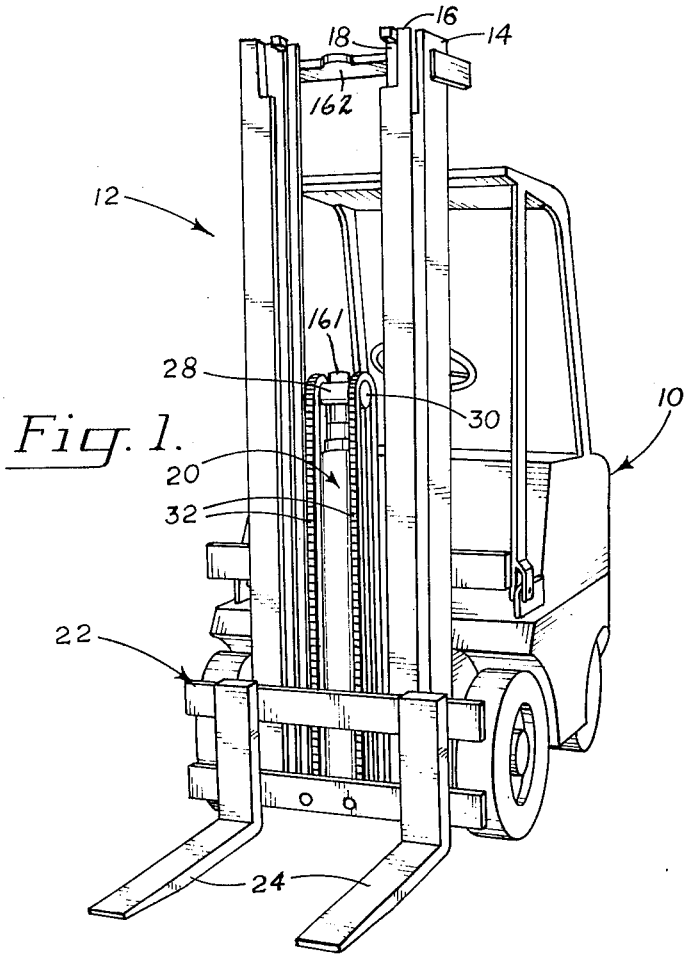
FIG. 1 is a front perspective view showing a lift truck with a triple-lift-type mast which is raised and lowered by a telescopic ram constructed in accordance with the present invention.

Turning now to the drawings, and referring first to FIG. 1, indicated generally at 10 is a conventional industrial lift truck, on the front of which is mounted a three-section telescopic mast 12. Mast 12 includes outer, intermediate and inner mast sections 14, 16, 18, respectively, which are adapted for vertical extension relative to one another with operation of a three-stage, fluid-actuated, single-acting ram 20 which is constructed in accordance with the present invention. A conventional carriage is shown at 22 — this carriage being roller-mounted in a conventional manner for travel up and down, on and along inner mast section 18. The three sections of the mast are also roller-mounted with respect to each other.

As is well understood, carriage 22 is adapted for mounting thereon of a wide variety of load-handling attachments. Shown in FIG. 1 as being mounted on carriage 22 are two lift forks 24.

Figure 2:
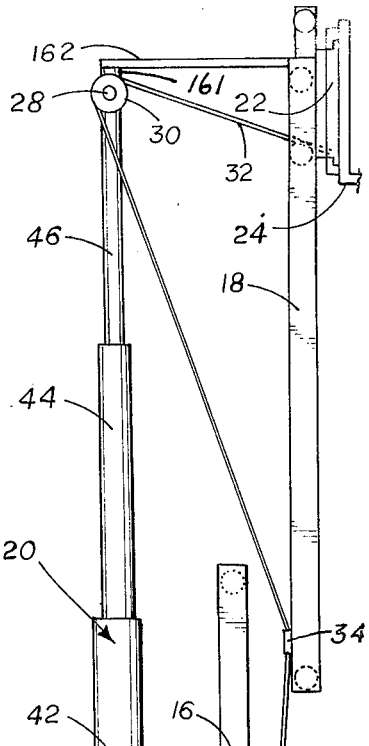
FIGS. 2, 3 and 4 are simplified schematic drawings showing three different stages of lift which are effected by operation of the ram in the truck of FIG. 1.
Figure 2:
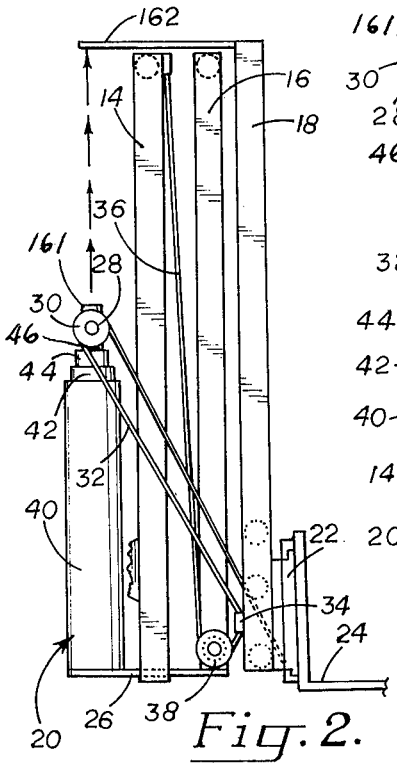

Referring for a moment to the schematic drawing in FIG. 2 along with the drawing of FIG. 1, the base of ram 20 is suitably seated herein upon intermediate mast section 16. The means providing such seating is shown schematically in FIG. 2 as a plate 26 — this plate being shown near the base of the intermediate mast section. The upper end of ram 20 carries what is known as a crosshead 28 on which are mounted a pair of sheaves, such as sheave 30, over which are trained two carriage chains 32. As can be seen particularly in FIG. 2, one set of ends of these chains is anchored at 34 to the lower end of inner mast section 18, and the other set of ends of the chains is suitably anchored to carriage 22.

With further reference still to FIG. 2, also included in the means which interconnects ram 20 and mast 12 are two so-called bootstrap chains, one of which is shown at 36 in FIG. 2. One set of ends of chains 36 is anchored at the upper end of outer mast section 14, with the other set of ends of these chains being secured to the inner mast section at the location of previously mentioned anchor 34. Between their ends, the bootstrap chains are trained over sheaves, such as sheave 38, which are journaled near the base of intermediate mast section 16.

Neither the details of construction of mast 12, nor of the specifics of the interconnections between the mast and ram 20 are of any consequence to the present invention, and hence will not be discussed herein in any further detail. However, a mast like that which is generally illustrated herein, and which is entirely satisfactory is fully described in copending U.S. patent application Ser. No. 630,782, filed Nov. 11, 1975, now abandoned, by Cor A. Emke, Harlan D. Olson and Harry F. Weinert for "Telescopic Mast For Industrial Lift Truck".

Figure 3:
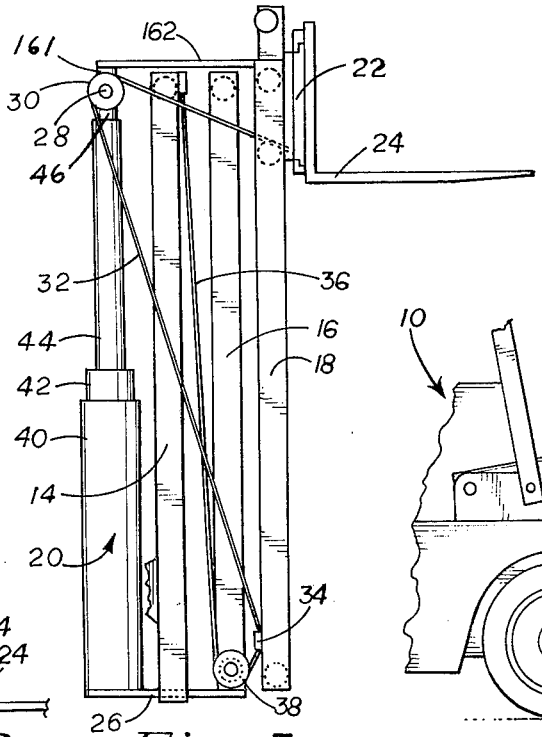
Figure 4:
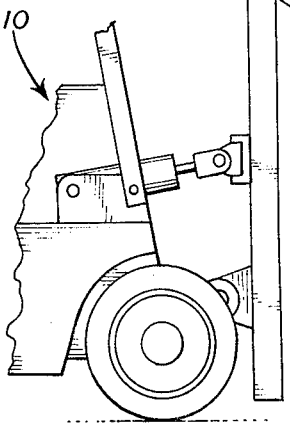

As is contemplated by the present invention, ram 20 takes the form of a three-stage, four-section assembly. Referring briefly to FIGS. 3 and 4 along with FIG. 2, the four sections of the ram are shown at 40, 42, 44, 46. Section 40 will also be referred to herein as a cylinder, section 42 as an outer piston which is slidably mounted within and extensible from the cylinder, section 44 as an intermediate piston which is slidably mounted within and extensible from the outer piston, and section 46 as an inner piston which is slidably mounted within and extensible from the intermediate piston.

Figure 6:
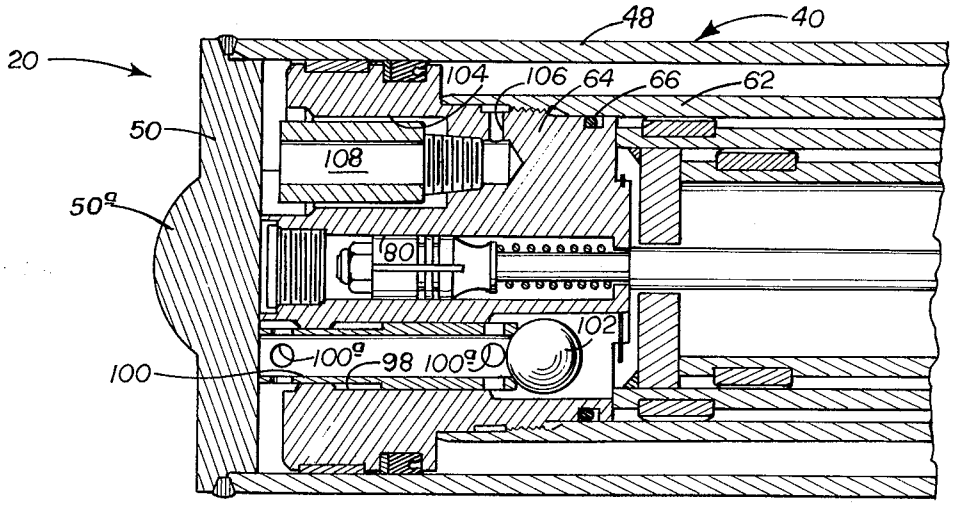
FIG. 6 is a view taken in an axial plane normal to the plane of FIG. 5, and of the left end of the ram as shown in FIG. 5.
Figure 5:
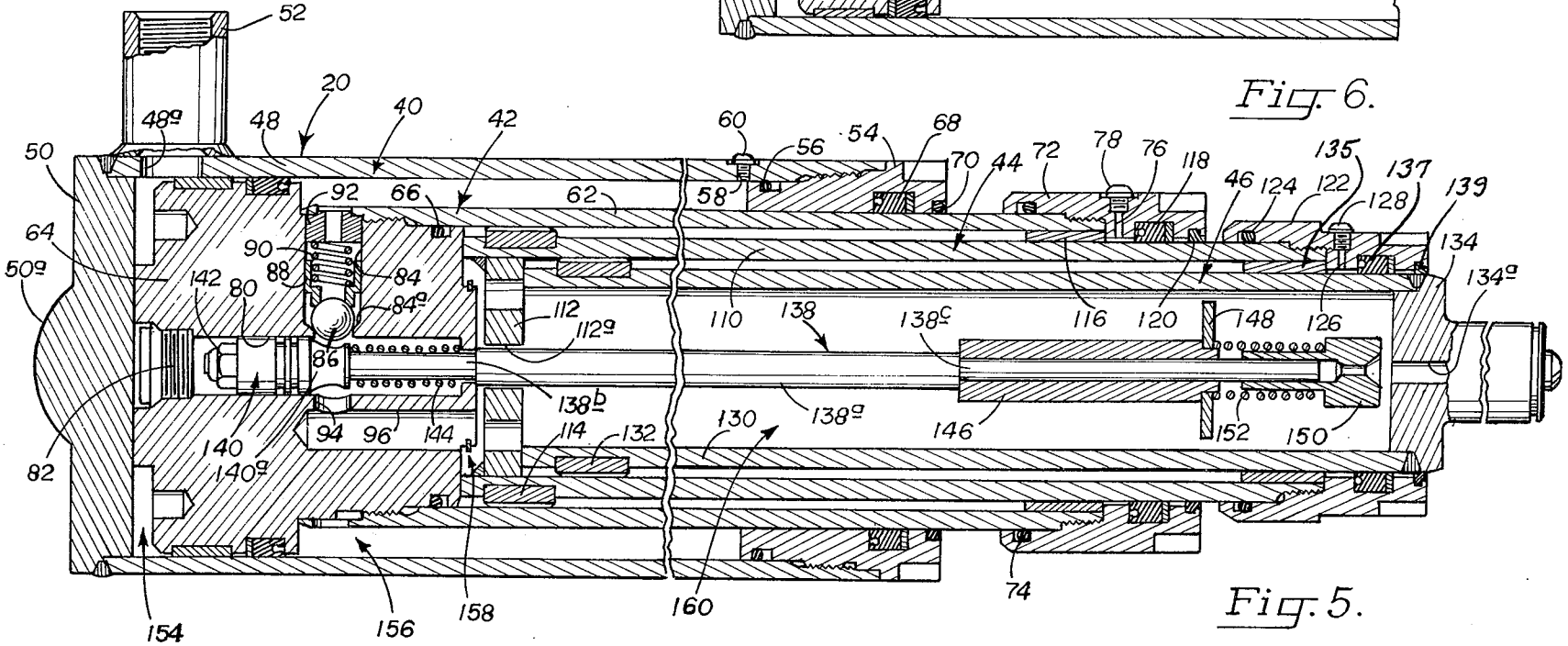
FIG. 5 is an enlarged fragmentary drawing showing details of construction of the proposed ram.

FIGS. 5 and 6 illustrate details of construction of ram 20, and attention is now turned to these two figures.

Cylinder 40 includes an elongated cylindrical tube 48, the left end of which is closed by a cap 50 that is joined to the tube as by welding. Formed on the outside of cap 50, and located along the axis of ram 20, is a slightly less-than-hemispherical bulge **50*a* which accommodates seating of the ram on the intermediate mast section. A port 48*a* is provided adjacent the left end of tube 48, and a nipple 52 is joined, as by welding, to the outside of the tube in alignment with this port. It is through nipple 52 and port 48*a*** that hydraulic fluid is supplied and exhausted to extend and contract the ram.

The right end of tube 48 is fitted with a screwed-in-retaining ring 54 which is sealed to the tube by a seal assembly 56. This retaining ring slidably receives ram section 42 and restrains this section against axial retraction from cylinder 40. A port 58 is provided in the wall of tube 48 adjacent ring 54, this port being shown closed in FIG. 5 by a cap screw 60 which is suitably sealed to the tube. Port 58 is provided for bleeding air from the cylinder.

Ram section 42, which has been referred to above as the outer piston in ram 20, includes an elongated cylindrical tube 62, the left end of which is screwed onto a piston head 64 that is slidably mounted within tube 48. A seal assembly 66 seals tube 62 to piston head 64. The outside of tube 62 is sealed to retaining ring 54 by an annular seal assembly 68. An annular wiper 70 is mounted on ring 54, with the inner circumferential margin of this wiper bearing on the outside of tube 62.

Screwed onto the right end of tube 62 in FIG. 5 is a retaining ring 72 which is sealed to the tube through an annular seal assembly 74. Ring 72 is provided for restraining ram section 44 against axial retraction from the ram assembly. An air-bleeding port 76 is provided in ring 72, with this port being closed off by a cap screw 78 which is suitably sealed to the ring.

Provided within piston head 64 is a stepped-diameter, axially central bore 80, the left end of which in FIGS. 5 and 6 is closed off by a plug 82. As can be seen particularly in FIG. 5, joining with bore 80 is a radially extending bore 84, the lower end of which in FIG. 5 is angled inwardly to provide a conical valve seat **84*a*. Disposed within bore 84 are a ball 86, a stepped-diameter ball spacer 88, a compressed biasing spring 90, and a tubular plug 92**. The function of this mechanism will be explained shortly.

Also seen in FIG. 5 as joining with bore 82 is a short radially extending bore 94 which joins at a right angle with an off-center axially extending bore 96 that opens to the right end of piston head 64 in FIG. 5. Bore 94 is substantially diametrically opposed to bore 84.

Referring specifically now to FIG. 6, which figure shows an axial section through piston head 64 in the plane which is normal to the plane of FIG. 5, also formed in head 64 is an off-center, stepped-diameter, axially extending bore 98, in the small diameter portion of which is slidably mounted an elongated tube 100. Opposite ends of tube 100 are provided with radially extending ports such as those shown at 100*a*. Disposed within the large diameter portion of bore 98, and shown seated against the right end of tube 100 in FIG. 6, is a ball 102.

Further formed in piston head 64, and shown near the top of FIG. 6, is an off-center, stepped-diameter, axially extending bore 104 which joins with a radially extending bore 106. Screwed into bore 104 is a conventional relief valve 108, the specific construction of which is of no concern to an understanding of the present invention. The way in which this valve performs will also be explained shortly.

Ram section 44, which has been referred to previously as the intermediate piston in ram assembly 20, includes an elongated cylindrical tube 110 to the inside left end of which is joined an apertured plate 112. An annular bearing 114 is suitably joined to the outside of the left end of tube 110 in FIG. 5, which bearing rides on the inside of the wall of tube 62. It should be noted that provided in plate 112 is an axially central bore or aperture 112*a* which is aligned with previously mentioned bore 80.

Mounted on the inside of the right end of previously mentioned tube 62 is an annular bearing 116 which engages the outside surface of tube 110. The outside of tube 110 is sealed to retaining ring 72 by an annular seal assembly 118. A wiper 120, similar to previously mentioned wiper 70, is suitably mounted on ring 72 for wiping against the outside of tube 110.

Joined to the right end of tube 110 in FIG. 5 is a retaining ring 122 which is similar in construction to ring 72. Thus, ring 122 is sealed to tube 110 through an annular seal assembly 124 which is like seal assembly 74. A radially extending port 126 is provided in ring 122 for air-bleeding purposes — this port being closed by a cap screw 128 which is suitably sealed to the ring.

Ram section 46 which constitutes the inner piston of ram assembly 20 includes an elongated cylindrical tube 130 on the outside of the left end of which in FIG. 5 is suitably mounted an annular bearing 132 which is like previously mentioned bearing 114. Bearing 132 rides on the inside surface of the wall in tube 110. The right end of tube 130 is closed by a cap 134, which cap is provided with an axial bore 134*a*. A cap screw 136 closes the right end of bore 134*a* in FIG. 5, with this cap screw being suitably sealed to cap 134. Bore 134*a* is provided for air-bleeding purposes. A bearing 135 is mounted on the inside right end of tube 110 for engaging the outside surface of tube 130. Tube 130 is sealed to ring 122 by a seal assembly 137. Also, a wiper 139 is provided on ring 122 for wiping on the outside of tube 130.

Completing a description of ram 20, disposed axially centrally within the ram is an elongated cylindrical rod 138 which includes a central large diameter portion 138*a* joining integrally with a pair of smaller diameter end portions 138*b*, 138*c*. The left end of central portion 138*a* extends, as seen in FIG. 5, through aperture 112*a* in plate 112, with the shoulder which is formed between this portion and portion 138*b* being shown seated against the right end of piston head 64 in FIG. 5. Rod portion 138*b* extends into bore 80, and mounted on this rod portion is a generally cylindrical plunger 140 which is retained on the rod portion by means of a retaining nut 142. Plunger 140 is slidably mounted within bore 80 as shown, this plunger including, adjacent its right end in FIG. 5, a double-tapered cam portion 140*a*. A biasing spring 140, which is under compression, acts between piston head 64 and plunger 140.

Slidably mounted on rod portion 138*c* is an elongated tube 146, the right end of which in FIG. 5 is stepped to receive, as shown, a circular plate 148. A nut 150 is screwed onto the right end of rod portion 138*c* in FIG. 5, and a biasing spring 152, which is under compression, acts between this nut and the assembly comprising tube 146 and plate 148.

Referring still for a moment to FIGS. 5 and 6, there are several chambers which are defined within ram 20, which chambers are of importance in connection with the way in which the ram functions. More specifically, chambers 154, 156 are provided on opposite sides of piston head 64, which chambers are between ram sections 40, 42. Another chamber 158 is defined between ram sections 42, 44, and a chamber 160 is defined between ram sections 44, 46. For reasons which will soon become apparent, ram 20 is constructed whereby the effective working surface area for pressure fluid on the left side of piston head 64 in FIGS. 5 and 6 is substantially exactly twice that on the left side of ram section 44. Further, the effective working surface area on the right side of piston head 64, which area is exposed to chamber 156, is substantially exactly the same as the working surface area for pressure fluid on the left side of ram section 46.

Explaining briefly certain terms which are used herein, the bores formed in piston head 64 are referred to sometimes as fluid passage means. The valves provided therein are called fluid-flow control means. The sides of ram sections 42, 44, 46 on which pressure fluid acts to extend the ram constitute the high pressure sides of these parts. The opposite sides are called the low pressure sides.

Considering now how the ram of the invention performs, it will be recalled that in FIGS. 5 and 6 the ram is shown in a completely contracted condition. Such also is true with respect to the ram condition shown in FIGS. 1 and 2. Considering conditions of the various valves which are provided in piston head 64, ball 86 rests against valve seat 84*a* and thus closes off bore 84. By virtue of the position of ball 102 which is under the influence of tube 100, fluid communication is provided through bore 98 between opposite sides of piston head 64. It will be noted in FIG. 6 that the left end of tube 100 therein is resting against the right side of cap 50 in the figure. It should be recalled that while in FIGS. 5 and 6 the ram is shown in a horizontal position, actually when it is used it is disposed vertically, with what appears as the left side of the ram in these figures forming its base, and what is shown as the right side forming its top.

To extend the cylinder from its contracted condition, pressure fluid is admitted to the ram through nipple 52 and port 48*a*. Let us assume for the purpose of the present explanation that such pressure fluid is introduced to the ram at a substantially constant flow rate. What first occurs is that section 44, carrying section 46 with it as a unit, extends from section 42. Section 42 is restrained against movement because of the fact that fluid is captured in chamber 156. Because the effective working surface area for pressure fluid on ram section 44 is considerably greater than that on section 46, section 46 at this time does not extend relative to section 44.

As ram section 44 nears the limit of its allowed extension relative to section 42, plate 112 engages tube 146 on rod 138, shifting this tube, along with plate 148, against the action of spring 152 toward nut 150. Such action obviously further compresses spring 152, and the reason for this will be explained in a moment. With slight further extension of section 44, tube 146 engages the left end of nut 150 in FIG. 5, and as a consequence, rod 138 begins to shift to the right in FIG. 5 (upwardly as the ram is actually disposed).

Such movement of rod 138 causes plunger 140 to shift, and the cam portion of the plunger to engage ball 86. Engagement of cam portion 140*a* and ball 86 opens bore 84 to permit the escape of fluid from chamber 156. With slight shifting of ball 86, spring 152 produces a snap-action shifting of rod 138, which quickly completely unseats ball 86.

Assuming that the rate of supply of pressure fluid to the ram remains constant, what now occurs is that ram section 42 begins to extend from section 40. It will be obvious that this is now possible because of the fact that bore 84 is open, and pressure fluid can escape from chamber 156. As section 42 begins to extend, and referring for a moment to FIG. 6, tube 100 and ball 102 shift downwardly by gravity to close off bore 98. With closure of this bore, resulting from seating of ball 102 against the shoulder in the bore shown therefor in FIG. 6, the pressure of fluid acting on the right side of piston head 64 will be greater than that acting on the left side of the piston head. Hence, as section 42 extends, ball 102 remains seated to prevent the flow of fluid through bore 98.

Because of the fact, previously mentioned, that the effective working surface area on the left side of piston head 64 is substantially exactly twice that on the left side of ram section 44, section 42 now extends from section 40 at one-half the speed that section 44 initially extended from section 42. What further occurs is that fluid which escapes from chamber 156 is, essentially, pumped into chamber 158, and thence into chamber 160 to cause simultaneous extension of ram section 46 from section 44. Because of the fact, also previously mentioned, that the working surface area for pressure fluid on piston head 64 which faces chamber 156 is the same as that provided on ram section 46, section 46 extends relative to section 44, at substantially exactly the same speed that section 42 extends relative to section 40. It will thus be apparent that the overall rate at which the length of ram 20 is now increasing is substantially exactly the same as the rate at which it lengthened with section 44 originally extending.

Thinking about this overall operation, it will be obvious further that the sequence of movements of the various sections in the ram is positively controlled. For example, during initial ram extension, section 42 is positively prevented from movement by virtue of the fluid which is captured in chamber 156. Section 44 extends at this time, without any relative movement between it and section 46, by virtue of the difference that exists in the effective working surface areas on these two sections that are exposed to pressure fluid. When bore 84 is opened to allow the escape of fluid from chamber 156, section 42 next begins to move relative to section 40, and automatically produces simultaneous like movement of section 46 relative to section 44.

When pressure fluid is exhausted from the extended ram, the reverse sequence of events takes place, also under positive control. Thus, what initially occurs is that section 46 contracts into section 44 simultaneous with section 42 contracting into section 40. It will be apparent that as piston head 64 approaches bottoming out on cap 50, tube 100 (see FIG. 6) engages the cap and lifts ball 102 to open bore 98 again. As a consequence, the ram continues to contract with section 44 (carrying section 46 along with it) contracting within section 46. Slight contraction of section 44 shifts plate 112 out of engagement with tube 146, and allows spring 144 to return plunger 140 to the position in which it is shown in FIG. 5. Spring 90 then reseats ball 86 against valve seat 84*a*, and once again, fluid is captured in chamber 156. So long as the rate of exhaust of fluid from the ram is maintained substantially constant, the overall contraction of the ram from full extension to full contraction is also substantially constant.

Turning for a moment to FIGS. 2, 3 and 4, and explaining how ram 20 thus performs with the other equipment shown in these figures, it has previously been mentioned that in FIG. 2 the ram is shown in a fully contracted state. In its first stage, so to speak, of extension, where sections 44, 46 extend as a unit, sheaves 30 on crosshead 28 are lifted so as to act on carriage chains 32 and to lift carriage 22 on inner mast section 18. The change in position of the carriage on the inner mast section during this operation is illustrated by comparing FIGS. 2 and 3. It will be obvious that because of the way in which the carriage chains are connected, the carriage will travel vertically on the inner mast at substantially exactly twice the speed at which ram sections 44, 46 are traveling vertically.

In the mast and ram combination shown herein, it is intended that a pad 161 mounted on the upper end of ram section 46 physically engage a part which is joined to inner mast section 18 upon substantially full extension of section 44 from section 42. This part is illustrated in FIGS. 2, 3 and 4 as a bar 162 which is shown joined to the top of inner mast section 18. Engagement between this bar and pad 161 is seen in FIGS. 3 and 4.

With continued extension of the ram, inner mast section 18 is directly lifted, and through the action of bootstrap chains 36, lifts intermediate mast section 16 relative to outer mast section 14. Obviously, as the intermediate mast section lifts, ram 20 also lifts. When the ram has fully extended, the positions of the carriage and of the various sections in the mast are as illustrated in FIG. 4.

It will be apparent that so long as the overall rate of extension of the ram is substantially constant, the vertical travel speed of carriage 22 relative to the ground is also substantially constant.

Thus, it will be apparent that the ram of the invention meets all of the objectives ascribed to it earlier. Its four-section construction allows it to have a relatively short or small vertical profile when fully contracted, which condition promotes good visibility for the operator of a lift truck. This condition is clearly illustrated in FIG. 1. The unique inside construction of the ram which promotes substantially constant extension speed when pressure fluid is supplied at a substantially constant rate, obviates the problem of jolting a load as it is raised or lowered. Further, it is apparent how the internal construction of the ram produces positive sequence control. Thus, the ram is easily incorporated with a mast like mast 12, without the latter requiring any latches or the like to effect sequence control.

While a preferred embodiment of the invention has been described, it is apparent that variations and modifications may be made without departing from the spirit of the invention.

It is claimed and desired to secure by Letters Patent:

1. A three-stage, fluid-actuated, extensible-contractible device for an industrial lift truck or the like, comprising first, second, third and fourth nested, relatively reciprocable sections, said first, second and third sections being extensible from said second, third and fourth sections, respectively, port means for introducing and exhausting pressure fluid to extend and contract said device, respectively, means on said first, second and third sections defining working surface areas on which pressure fluid acts to extend said sections, said area on said first section being less than that on said second section, and said area on said second section being less than that on said third section, and fluid-flow control means within said device for controlling the distribution of fluid therein, said control means, with pressure fluid supplied to said port means at a substantially constant rate, and in cooperation with said areas, producing, during an initial mode of extension of said device, extension of said second section from said third section to cause a certain overall extension speed for said device, and thereafter, and during a later mode of extension producing simultaneous extension of said first section from said second section and of said third section from said fourth section to maintain the overall extension speed of said device substantially constant at said certain speed.

2. The device of claim 1, wherein the working surface area of said second section is substantially exactly one-half that of said third section.

3. The device of claim 1, wherein said fluid-flow control means includes means defining a fluid chamber between said third and fourth sections, wherein the capture of fluid prevents relative movement between said two sections, means defining a fluid passage communicating with said chamber and with said working surface area on said first section, and plural-condition valve means in said passage for controlling fluid flow from said chamber, said valve means having one condition in said initial operating mode capturing fluid in said chamber, and thus preventing extension of said third section from said fourth section, and having another condition during said later operating mode, permitting discharge of fluid from said chamber to allow extension of said third section from said fourth section, with such discharged fluid acting on said first section's working surface area to produce simultaneous extension of said first section from said second section.

4. The device of claim 3, further including means in said device actuated by said second section substantially upon its reaching a maximum extension position relative to said third section for changing said valve means from its said one condition to its said other condition.

5. The device of claim 3, wherein the working surface area of said second section is substantially exactly one-half that of said third section.

6. A three-stage, fluid-actuated, extensible-contractible device for an industrial lift truck or the like, comprising first, second, third and fourth nested, relatively reciprocable sections, said first section being nested within said second section, said second section being nested within said third section, and said third section being nested within said fourth section, port means for introducing and exhausting pressure fluid to extend and contract said device, respectively, means on said first, second and third sections defining working surface areas on which pressure fluid acts to extend said device, said area on said first section being less than that on said second section, and that on said second section being substantially exactly one-half that on said third section, means defining a fluid chamber between said third and fourth sections, including means on said third section defining another working surface area which acts on fluid in said chamber during extension of said third section relative to said fourth section, said other area being substantially equal to said working surface area on said first section, and fluid passage means, including valving means, within said device for controlling the distribution of fluid therein to effect a two-mode extension of said device from a fully contracted to a fully extended condition, whereby, with pressure fluid supplied at a substantially constant rate to said port means, and during a first extension mode, said first and second sections move alone as a unit to produce overall extension of the device at a given speed, movement of said third section at such time being prevented by the capture of fluid within said chamber by said valving means, and during a second, subsequent mode, movement of said first and third sections at the same respective speeds relative to said second and fourth sections, respectively, whereby the overall extension of said device continues at said given speed, movement of said third section being enabled by the release by said valving means of fluid captured in said chamber.

7. The device of claim 6, wherein, during said second mode of extension of the device, movement of said first section relative to said second section is produced substantially exclusively by the pumping of fluid from said chamber by movement of said third section relative to said fourth section.

8. The device of claim 6, further including means in said device actuated by said second section substantially upon its reaching a maximum extension position relative to said third section for operating said valving means to release fluid captured in said chamber.

9. A three-stage, fluid-actuated ram comprising first, second, third and fourth nested, relatively reciprocable sections adapted to extend in a common direction relative to one another to produce extension of said ram, said first, second and third sections being received within said second, third and fourth sections, respectively, with each of said first, second and third sections having a face on which pressure fluid acts to extend said section, the area of said face on said third section exceeding that of said face on said second section, and the area of said face on said second section exceeding that of said face on said first section, port means for introducing pressure fluid into, and exhausting it from, said ram to extend and contract the ram, respectively, means defining a fluid chamber between said third and fourth sections wherein fluid, if captured, inhibits relative extension of said third and fourth sections, fluid passage means communicating between said chamber and said faces on said first and second sections, and plural-condition valving means disposed within said fluid passage means for effecting two different, successive modes of extension in said ram with pressure fluid being supplied to said port means, said valving means, during an initial mode of extension of said ram from a fully contracted state, blocking the exhaust of fluid from said chamber to prevent relative movement between said third and fourth sections, the supply of pressure fluid to said port means in such mode under such circumstances causing the simultaneous extension of said first and second sections as a unit without relative movement between them, and said valving means during a later mode of extension in said ram, allowing the escape of fluid from said chamber through said passage, thereby permitting extension of said third section relative to said fourth section, with the escaped fluid then acting on said first unit's face to produce simultaneous related extension of said first unit relative to said second unit.

10. The ram of claim 9, further comprising means actuated by said second section substantially upon its reaching a maximum extension position relative to said third section for operating said valving means to allow the escape of fluid from said chamber, and thus to effect said later mode of extension in said ram.

11. The ram of claim 9, wherein the area of said face on said second section is substantially one-half that of said face on said third section, said fluid chamber-defining means includes means on said third section defining another working surface area which acts on fluid in said chamber during extension of said third section relative to said fourth section, said other working surface area being substantially equal to the area of said face on said first section, whereby during said initial mode said first and second sections extend at a certain speed relative to said fourth section to produce overall extension of the ram at said certain speed, and during said later mode, said first and third sections each move at one-half said certain speed relative to said second and fourth sections, respectively, whereby the overall extension speed of said ram continues at said certain speed.

12. A multistage, fluid-actuated telescopic ram providing a substantially constant rate of overall length increase from its fully contracted to its fully extended condition upon being supplied fluid under pressure at a substantially constant rate, comprising a cylinder having fluid inlet means therein, an outer telescoping member nested in said cylinder and adapted for movement to an extended, stop-limited position relative thereto, an intermediate telescoping member nested in said outer member and adapted for movement to an extended, stop-limited position relative thereto, an inner telescoping member nested in said intermediate member and adapted for movement to an extended, stop-limited position relative thereto, said outer, intermediate and inner members each having a high and a low pressure side, and each including a surface on its high pressure side on which fluid pressure acts to move the member toward its extended position, the area of said surface on said intermediate member being substantially one-half that of said surface on said outer member, means defining a first fluid passage extending from said inlet means for directing fluid pressure simultaneously against said surfaces on all three telescoping members, means defining a fluid chamber between said cylinder and the low pressure side of said outer member, said means including surface means on said outer member acting on fluid in said chamber upon extension of said outer member relative to said cylinder, said surface means on the low pressure side of said outer member being substantially equal in area to the area of said surface on the high pressure side of said inner member, means defining a second fluid passage connecting said chamber with the high pressure side of said inner member, normally closed valve means in said second passage for preventing the flow of fluid from said chamber, whereby said outer telescoping member is held against movement relative to said cylinder upon the application of fluid pressure to said inlet means, said application thereby effecting conjoint extension of said intermediate and inner members relative to said outer member and cylinder, and valve operating means within said ram actuated by said intermediate member substantially upon its reaching its stop-limited position for opening said valve means to allow fluid to flow from said chamber, whereby continued application of fluid pressure to said inlet means effects simultaneous extension of said outer member relative to said cylinder and of said inner member relative to said intermediate member.

13. The ram of claim 12, wherein said outer telescoping member includes an inner end portion separating said member's high and low pressure sides, said first fluid passage comprises a duct extending through said portion between such sides for fluid flow communication between said inlet means and the high pressure sides of said intermediate and inner telescoping members, and said ram additionally comprises another dual-condition valve means in said duct for controlling fluid flow between the high pressure side of said outer member and the high pressure sides of said intermediate and inner members, said other valve means being placed in one condition, permitting such flow, upon said outer member being in a substantially fully nested position relative to said cylinder, and being placed in another condition, preventing such flow, upon movement of said outer member a certain distance toward its extended position relative to said cylinder.

14. The ram of claim 13, which provides a substantially constant rate of overall length decrease during contraction of said ram from its fully extended toward its fully contracted condition upon the exhausting of pressure fluid from said inlet means at a substantially constant rate, and wherein said valve operating means includes means for keeping open said first-mentioned valve means during initial contraction of said ram to allow fluid flow into said chamber, said other valve means during said initial contraction being in said other condition preventing fluid flow from the high pressure sides of said intermediate and inner members to the high pressure side of said outer member, whereby exhausting of fluid from said inlet means first effects simultaneous contraction of said inner member relative to said intermediate member and of said outer member relative to said cylinder, and said cylinder includes means therein for placing said other valve means in said one condition upon said outer member reaching a substantially fully nested position relative to the cylinder, permitting fluid flow through said duct, whereby continued exhausting of fluid from said inlet means next effects conjoint contraction of said intermediate and inner members relative to said outer member and cylinder.

* * * * *